US011073775B2

(12) United States Patent
Nakura

(10) Patent No.: US 11,073,775 B2
(45) Date of Patent: Jul. 27, 2021

(54) TRANSFER DEVICE AND IMAGE FORMING APPARATUS INCORPORATING SAME

(71) Applicant: Makoto Nakura, Ibaraki (JP)

(72) Inventor: Makoto Nakura, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/815,820

(22) Filed: Mar. 11, 2020

(65) Prior Publication Data

US 2020/0301319 A1 Sep. 24, 2020

(30) Foreign Application Priority Data

Mar. 18, 2019 (JP) ..... JP2019-050390
Jan. 27, 2020 (JP) ..... JP2020-011024

(51) Int. Cl.
*G03G 15/16* (2006.01)

(52) U.S. Cl.
CPC ..... *G03G 15/1685* (2013.01); *G03G 15/167* (2013.01); *G03G 15/1605* (2013.01)

(58) Field of Classification Search
CPC ..... G03G 15/1685; G03G 15/167; G03G 15/1605; G03G 15/6594
See application file for complete search history.

(56) References Cited

U.S. PATENT DOCUMENTS 6,631,680 B2 * 10/2003 Metzler ..... G03G 15/1605 101/217
2001/0022607 A1 * 9/2001 Takahashi ..... B41J 2/01 347/103
2007/0172265 A1 * 7/2007 Matayoshi ..... G03G 15/162 399/302
2008/0240802 A1 10/2008 Nakura
2008/0267673 A1 10/2008 Tao et al.
2009/0060576 A1 3/2009 Tao et al.
2009/0062048 A1 3/2009 Nakura
2009/0180805 A1 7/2009 Nakura et al.
2012/0257915 A1 10/2012 Nakura et al.
2013/0195482 A1 8/2013 Nakura et al.
2013/0228969 A1 9/2013 Nakura et al.
2014/0348563 A1 11/2014 Nakura et al.
2015/0008639 A1 1/2015 Ueda et al.

FOREIGN PATENT DOCUMENTS

JP 11-052757 2/1999
JP 2007-264292 10/2007
JP 2008-076499 4/2008
JP 2011-158615 8/2011

* cited by examiner

*Primary Examiner* — Arlene Heredia
(74) *Attorney, Agent, or Firm* — Duft & Bornsen, PC

(57) ABSTRACT

A transfer device includes a rotatable image bearer configured to bear a toner image to be transferred to a recording medium, a first rotator, and a second rotator. The second rotator is configured to contact the first rotator via the rotatable image bearer to form a transfer nip in which the recording medium is sandwiched. The second rotator is rotatable with the image bearer. The transfer device satisfies a conditional expression (t1+R)/(t2+R)>0.98, where t1 represents a thickness of a thinnest recording medium, t2 represents a thickness of a thickest recording medium, and R represents a radius of curvature of the transfer nip.

6 Claims, 5 Drawing Sheets

TRANSFER DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2019-050390, filed on Mar. 18, 2019 and 2020-011024, filed on Jan. 27, 2020, in the Japan Patent Office, the entire disclosure of each of which is hereby incorporated by reference herein.

BACKGROUND

Technical Field

Embodiments of the present disclosure generally relate to a transfer device and an image forming apparatus such as a copier, a printer, a facsimile machine, or a multifunction peripheral (MFP) having at least two of such capabilities, incorporating the transfer device.

Description of the Related Art

In image forming apparatuses, when a toner image is transferred to a sheet as a recording medium, an image sub-magnification (image length) on the sheet may varies due to a difference in toner coverage. The toner coverage is an index indicating a ratio of the toner that covers the sheet. Specifically, the toner coverage corresponds to a toner adhesion amount and an image area rate. The toner adhesion amount is an amount of toner per unit area on the sheet and depends on whether the image is a monochrome text image or a full-color photographic image. The image area rate is a ratio of an image area to a sheet area and depends on whether the image is formed on a part of the sheet or the image is formed on the entire surface of the sheet.

SUMMARY

Embodiments of the present disclosure describe an improved transfer device that includes a rotatable image bearer configured to bear a toner image to be transferred to a recording medium, a first rotator, and a second rotator. The second rotator is configured to contact the first rotator via the rotatable image bearer to form a transfer nip in which the recording medium is sandwiched. The second rotator is rotatable with the image bearer. The transfer device satisfies a conditional expression $(t1+R)/(t2+R)>0.98$, where t1 represents a thickness of a thinnest recording medium, t2 represents a thickness of a thickest recording medium, and R represents a radius of curvature of the transfer nip.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
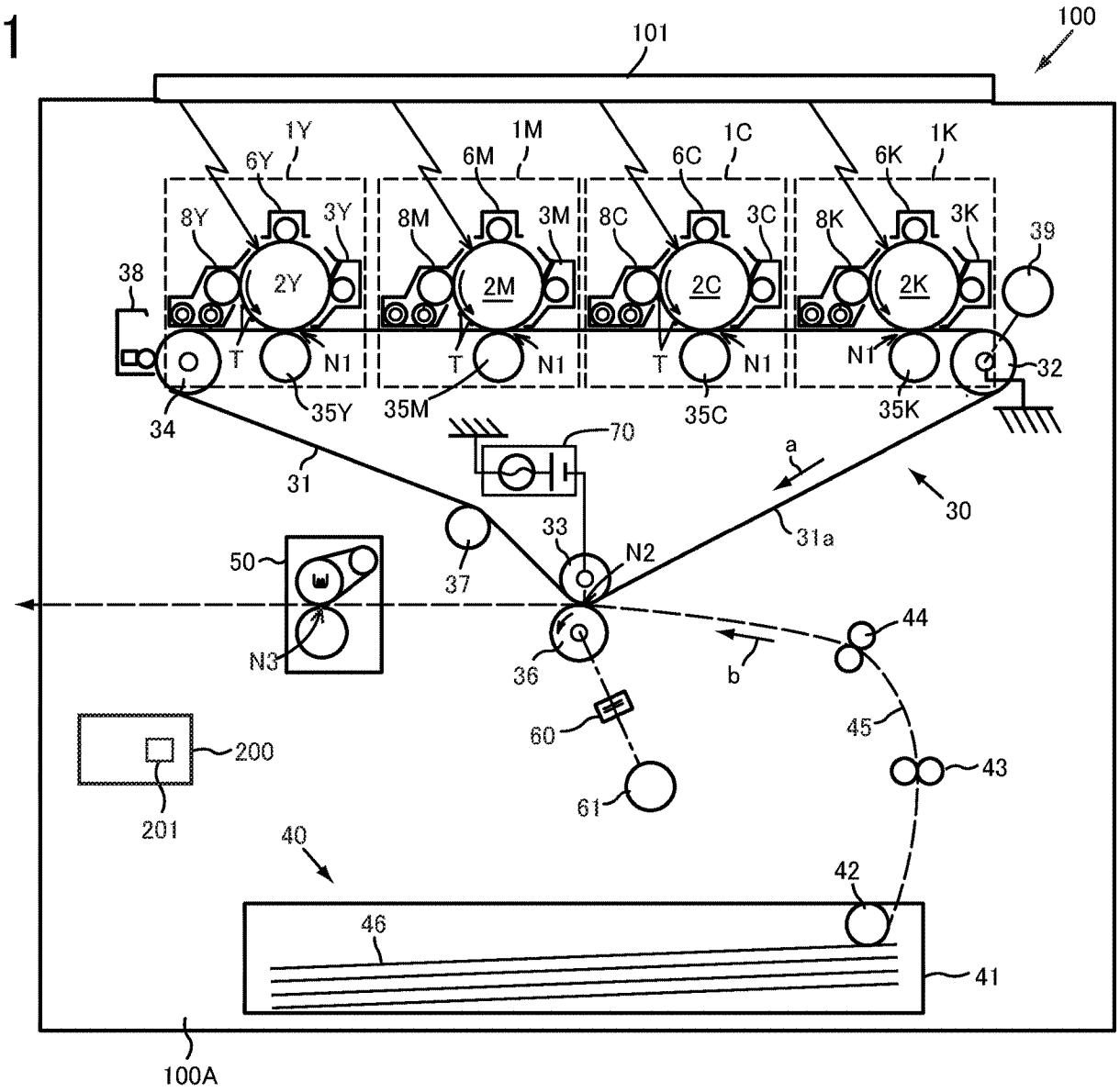
FIG. 1 is a schematic view illustrating a configuration of an image forming apparatus including a transfer device according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments according to the present disclosure are sequentially described with reference to the drawings. In the description of embodiments below, components having the same function and configuration are appended with the same reference codes, and redundant descriptions thereof may be omitted. Components in the drawings may be partially omitted or simplified to facilitate understanding of the configurations.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 illustrates an image forming apparatus, which is, for example, an electrophotographic color printer 100 (hereinafter, simply the "printer 100"). The printer 100 includes four image forming units 1Y, 1M, 1C, and 1K for forming yellow (Y), magenta (M), cyan (C), and black (K) toner images, an intermediate transfer unit 30 serving as a transfer device, a sheet feeder 40 including a sheet tray 41 to contain sheets (recording media) 46, and a fixing device 50.

The four image forming units 1Y, 1M, 1C, and 1K are similar in configuration except for the color of toner as a powdered developer employed therewithin. The image forming units 1Y, 1M, 1C, and 1K are replaced when the respective product lives expire. The image forming units 1Y, 1M, 1C, and 1K include drum-shaped photoconductors 2Y, 2M, 2C, and 2K serving as image bearers, photoconductor cleaning devices 3Y, 3M, 3C, and 3K, discharge devices, charging devices 6Y, 6M, 6C, and 6K, developing devices 8Y, 8M, 8C, and 8K, and the like, respectively. The components of each of the image forming units 1Y, 1M, 1C, and 1K are held in a common casing and construct a process cartridge removably installable in an apparatus body 100A of the printer 100. That is, each of the image forming units 1Y, 1M, 1C, and 1K is replaceable as a single unit.

The photoconductors 2Y, 2M, 2C, and 2K rotate counterclockwise in FIG. 1 by a driver such as a motor. The charging devices 6Y, 6M, 6C, and 6K each include a charging roller serving as a charger to which a charging bias is applied. The charging rollers contact or approach the photoconductors 2Y, 2M, 2C, and 2K, respectively, to generate electrical discharges therebetween, thereby uniformly charging the surfaces of the photoconductors 2Y, 2M, 2C, and 2K. In the present embodiment, the photoconductors 2Y, 2M, 2C, and 2K are charged by the charging rollers contacting the photoconductors 2Y, 2M, 2C, and 2K or disposed near the photoconductors 2Y, 2M, 2C, and 2K. Alternatively, corona chargers may be employed.

The surfaces of the photoconductors 2Y, 2M, 2C, and 2K, uniformly charged by the charging devices 6Y, 6M, 6C, and 6K, are optically scanned by exposure light such as laser beams emitted from an optical writing unit 101 disposed above the image forming units 1Y, 1M, 1C, and 1K. Thus, electrostatic latent images of yellow, magenta, cyan, and black are formed on the surfaces of the photoconductors 2Y, 2M, 2C, and 2K, respectively. The electrostatic latent images on the photoconductors 2Y, 2M, 2C, and 2K are developed with toners of the respective colors by the developing devices 8Y, 8M, 8C, and 8K, respectively, thereby forming visible toner images T. Thus, the toner images T are formed on the photoconductors 2Y, 2M, 2C, and 2K. The toner images T on the photoconductors 2Y, 2M, 2C, and 2K are primarily transferred onto a front face 31*a* of an intermediate transfer belt 31. The intermediate transfer belt 31, which is an endless belt, serves as an image bearer to bear the toner images T.

The photoconductor cleaning devices 3Y, 3M, 3C, and 3K remove residual toner adhering to the surfaces of the photoconductors 2Y, 2M, 2C, and 2K after a primary transfer process, that is, after the surfaces of the photoconductors 2Y, 2M, 2C, and 2K pass through corresponding primary transfer nips to be described later. The discharge devices remove residual electric charges remaining on the photoconductors 2Y, 2M, 2C, and 2K after the surfaces thereof is cleaned by the photoconductor cleaning devices 3Y, 3M, 3C, and 3K. The surfaces of the photoconductors 2Y, 2M, 2C, and 2K are initialized by the discharge devices in preparation for the subsequent imaging cycle.

The intermediate transfer unit 30 is disposed below the image forming units 1Y, 1M, 1C, and 1K. The intermediate transfer unit 30 stretches and rotates the intermediate transfer belt 31 in the clockwise direction in FIG. 1. In the present embodiment, a direction of rotation of the intermediate transfer belt 31 is indicated by arrow a in FIGS. 1 and 2.

The intermediate transfer unit 30 is removably installable in the apparatus body 100A as a single unit. Besides the intermediate transfer belt 31 serving as the belt-shaped image bearer and an intermediate transferor, the intermediate transfer unit 30 further includes a plurality of rotators: a drive roller 32, an opposing roller 33, a driven roller 34, four primary transfer rollers 35Y, 35M, 35C, and 35K, and a secondary transfer roller 36.

The intermediate transfer belt 31 is looped and stretched around the drive roller 32, the opposing roller 33 as a first rotator, the driven roller 34, the primary transfer rollers 35Y, 35M, 35C, and 35K. As the drive roller 32 rotates in the clockwise direction in FIG. 1 by a drive motor 39, the intermediate transfer belt 31 rotates in the same direction. That is, the intermediate transfer belt 31 is rotatable, and a linear velocity of the intermediate transfer belt 31 is controllable by the drive motor 39. A tension roller 37 is disposed outside of the loop of the intermediate transfer belt 31 and presses the intermediate transfer belt 31 from outside to inside of the loop, thereby applying tension to the intermediate transfer belt 31. In the present embodiment, the intermediate transfer belt 31 is an endless elastic belt including a plurality of layers. The intermediate transfer belt 31 serves as the image bearer onto which the toner images T on the photoconductors 2Y, 2M, 2C, and 2K are primarily transferred.

The intermediate transfer belt 31 is interposed between the primary transfer rollers 35Y, 35M, 35C, and 35K, and the photoconductors 2Y, 2M, 2C, and 2K, thereby forming primary transfer nips N1 for yellow, magenta, cyan, and black, where the surfaces of the photoconductors 2Y, 2M, 2C, and 2K contact the front face 31*a* or an image bearing face of the intermediate transfer belt 31. A primary transfer bias is applied to each of the primary transfer rollers 35Y, 35M, 35C, and 35K by a transfer bias power source. Accordingly, transfer electric fields are generated between the primary transfer rollers 35Y, 35M, 35C, and 35K, and the toner images of yellow, magenta, cyan, and black on the photoconductors 2Y, 2M, 2C, and 2K.

A yellow toner image formed on the photoconductor 2Y enters the primary transfer nip N1 for yellow as the photoconductor 2Y rotates. Subsequently, the yellow toner image is primarily transferred from the photoconductor 2Y to the intermediate transfer belt 31 by the transfer electric field and a nip pressure. The intermediate transfer belt 31, on which the yellow toner image has been transferred, passes through the primary transfer nips N1 for magenta, cyan, and black. Then, a magenta toner image, a cyan toner image, and a black toner image are primarily transferred from the photoconductors 2M, 2C, and 2K and sequentially superimposed on the yellow toner image. Accordingly, a composite toner image, in which the toner images of four colors are superimposed, is formed on the intermediate transfer belt 31 in the primary transfer process.

The description above concerns full-color image formation to form the composite toner image with four color toners. However, the printer 100 may form a single-color image with one of yellow, magenta, cyan, and black toners and may transfer the single-color image to the intermediate transfer belt 31. Alternatively, the printer 100 may form a multi-color image with at least two of yellow, magenta, cyan, and black toners and may transfer the multi-color image to the intermediate transfer belt 31.

A secondary transfer roller 36 is disposed below the loop of the intermediate transfer belt 31 and opposite the opposing roller 33. The secondary transfer roller 36 serves as a second rotator that contacts the opposing roller 33 via the intermediate transfer belt 31 to sandwich the sheet 46 as the recording medium. The secondary transfer roller 36, together with the opposing roller 33, forms a secondary transfer nip N2 to transfer the toner image formed on the rotatable intermediate transfer belt 31 to the sheet 46.

In the present embodiment, a drive motor 61 serving as a driving source rotates the secondary transfer roller 36. A torque limiter 60 is disposed between the secondary transfer roller 36 and the drive motor 61. When a certain torque is applied to the torque limiter 60, the torque limiter 60 slides to cut off the torque. Therefore, when the secondary transfer roller 36, which contacts the intermediate transfer belt 31, receives the torque from the intermediate transfer belt 31 that exceeds a predetermined torque, the secondary transfer roller 36 is rotated with the movement of the intermediate transfer belt 31.

In the present embodiment, a power supply 70 applies a secondary transfer bias to the opposing roller 33. Alternatively, the power supply 70 may apply the secondary transfer bias to the secondary transfer roller 36 disposed opposite the opposing roller 33. When the secondary transfer bias is applied to the secondary transfer roller 36, the secondary transfer bias is opposite in polarity to the toner. When the secondary transfer bias is applied to the opposing roller 33, the secondary transfer bias is identical in polarity to the toner.

The sheet feeder 40 is disposed below the intermediate transfer unit 30. The sheet feeder 40 includes a feed roller 42 and the sheet tray 41 serving as a storage to contain the bundle of multiple sheets 46. A conveyance path 45 is disposed between the sheet feeder 40 and the secondary transfer nip N2.

The feed roller 42 contacts a top sheet 46 of the bundle of multiple sheets 46 in the sheet tray 41. As the feed roller 42 rotates at a predetermined timing, the feed roller 42 feeds the top sheet 46 from the sheet tray 41 to the conveyance path 45. The sheet 46 is transported in the direction indicated by arrow b (i.e., sheet conveyance direction). A conveyance roller pair 43 and a registration roller pair 44 are disposed along the conveyance path 45. The registration roller pair 44 is disposed upstream from the secondary transfer nip N2 in the sheet conveyance direction indicated by arrow b in FIG. 1. The conveyance roller pair 43 transports the sheet 46 in the conveyance path 45, and then the registration roller pair 44 forwards the sheet 46 to the secondary transfer nip N2 so that the sheet 46 coincides with the toner image on the front face 31*a* of the intermediate transfer belt 31 in the secondary transfer nip N2.

In the secondary transfer nip N2, the toner images on the front face 31*a* of the intermediate transfer belt 31 are collectively transferred onto the sheet 46 by a secondary transfer electric field and a nip pressure, thereby forming a full-color toner image on the sheet 46. After the intermediate transfer belt 31 passes through the secondary transfer nip N2, substances, such as untransfered residual toner and paper dust, adhere to the front face 31*a* of the intermediate transfer belt 31. The residual toner and paper dust are removed from the intermediate transfer belt 31 by a belt cleaning device 38 that contacts the front face 31*a* of the intermediate transfer belt 31.

The fixing device 50 is disposed downstream from the secondary transfer nip N2 in the sheet conveyance direction indicated by arrow b in FIG. 1. The sheet 46 on which the toner image is transferred is transported to the fixing device 50. The fixing device 50 sandwiches the sheet 46 at a fixing nip N3 and applies heat and pressure to the sheet 46. As a result, the full-color toner image is softened and fixed on the sheet 46. After the toner image is fixed on the sheet 46, the sheet 46 is discharged from the fixing device 50 and ejected outside the apparatus body 100A.

A detailed description is given below of the opposing roller 33, the secondary transfer roller 36, and the secondary transfer nip N2.

Figure 2A:
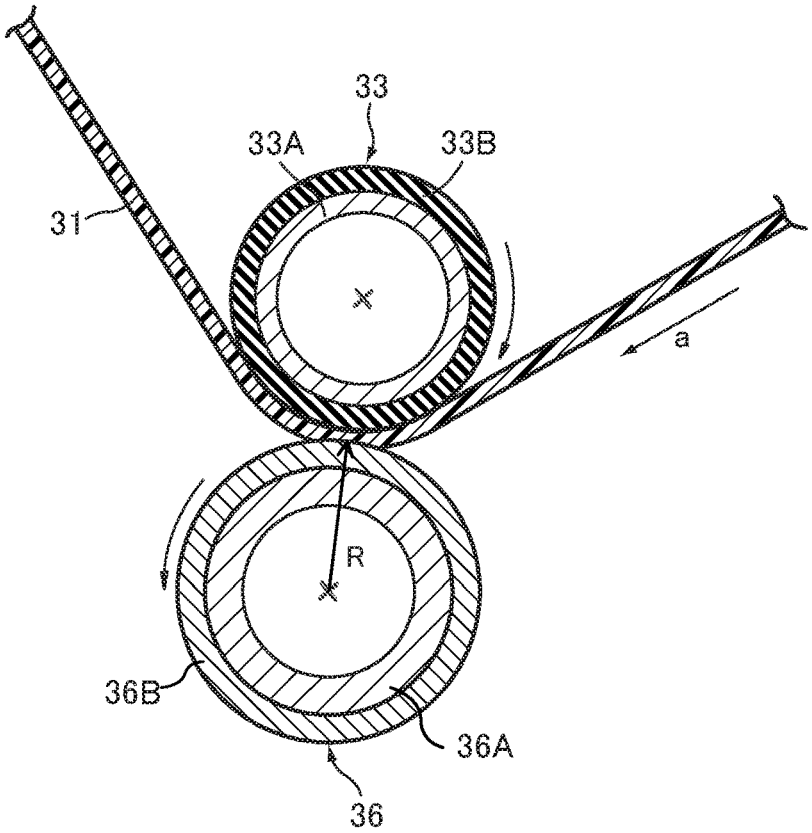
FIGS. 2A and 2B are enlarged views illustrating examples of the transfer device forming a transfer nip.
Figure 2B:
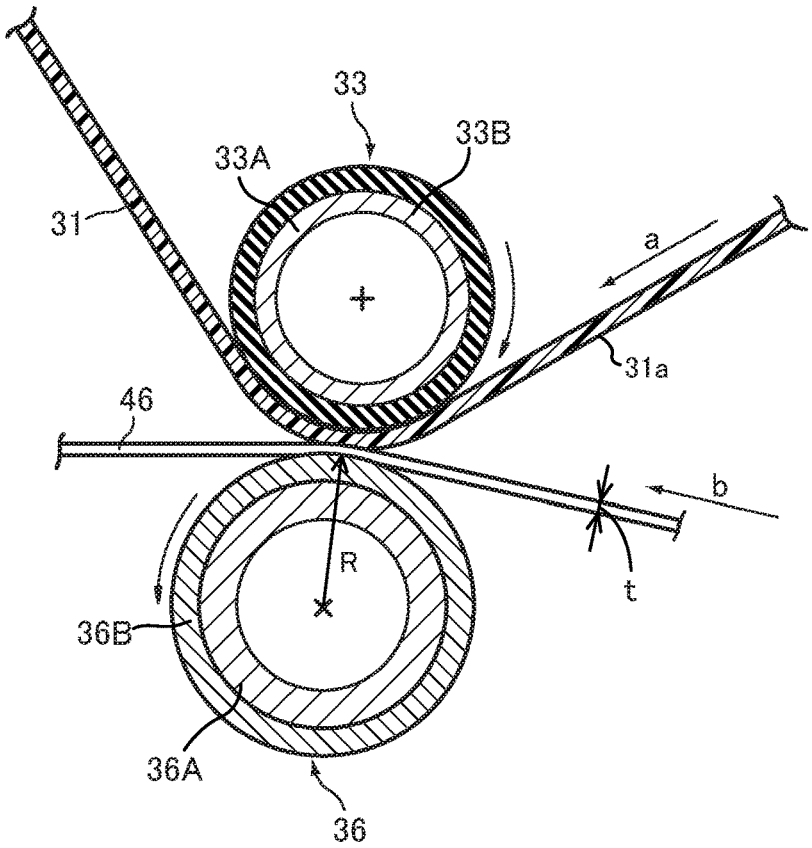

As illustrated in FIGS. 2A and 2B, the opposing roller 33 includes a cylindrical core 33A and a sponge rubber layer 33B coated on the outer surface of the core 33A. The secondary transfer roller 36 includes a cylindrical core 36A and a rubber layer 36B coated on the outer surface of the core 36A. The rubber layer 36B is harder than the sponge rubber layer 33B, and the surface of the rubber layer 36B does not substantially deform when the opposing roller 33 and the secondary transfer roller 36 press against each other, thereby forming the secondary transfer nip N2. In the present embodiment, in a state where the opposing roller 33 and the secondary transfer roller 36 are in contact with each other, the shape of the sheet 46 when the sheet 46 passes through the secondary transfer nip N2 is an upwardly convex arc shape. The convex arc shape has a radius of curvature obtained by adding a thickness t of the sheet 46 to a radius R of the secondary transfer roller 36. In other words, the radius of curvature of the secondary transfer roller 36 is R, and the radius of curvature of sheet surface, considering the sheet thickness, is t+R. A radius R of the secondary transfer roller 36 corresponds to the radius of curvature of the secondary transfer nip N2.

In the present embodiment, the radius R of the secondary transfer roller 36 satisfies a conditional expression $(t1+R)/(t2+R)>0.98$, where t1 is the thickness of the thinnest sheet and t2 is the thickness of the thickest sheet among the sheets 46 used in the printer 100.

In the comparative example, the radius R is 15 mm, the thickness t1 is 0.05 mm, and the thickness t2 is 0.40 mm. As a result, $(t1+R)/(t2+R)=0.977<0.98$. This does not satisfy the conditional expression.

On the other hand, in the present embodiment, for example, the radius R is 24 mm, the thickness t1 is 0.05 mm, and the thickness t2 is 0.40 mm. As a result, $(t1+R)/(t2+R)=0.986>0.98$. This satisfies the conditional expression.

That is, in the present embodiment, the thickness t of the sheet 46 used in the printer 100 ranges from t1 to t2 and the radius of curvature of the secondary transfer roller 36 at the secondary transfer nip N2 is R. This configuration satisfies $(t1+R)/(t2+R)>0.98$. The thicknesses t1 and t2 of the sheet 46 to be used in the printer 100 are rewritably stored in a memory 201 of a control unit 200 provided in the printer 100 as illustrated in FIG. 1.

Figure 3:
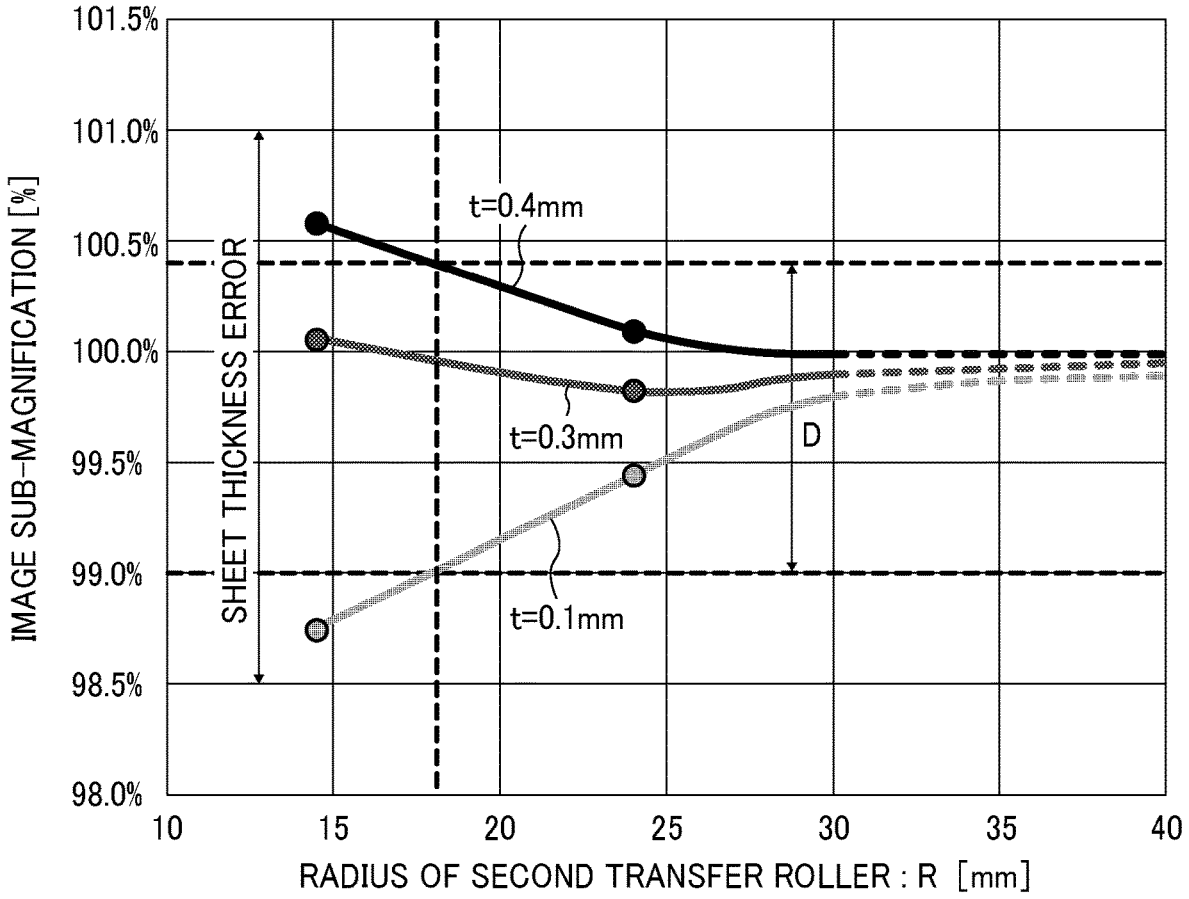
FIG. 3 is a graph illustrating a relation between a radius R of a secondary transfer roller (second rotator) of the transfer device and a sheet thickness error of image sub-magnification due to a thickness of a sheet.

FIG. 3 is a graph illustrating the effect of increasing the diameter of the secondary transfer roller 36. In FIG. 3, the horizontal axis represents the radius R of the secondary transfer roller 36, and the vertical axis represents an image sub-magnification that corresponds to the length of the image (image length) on the sheet 46. FIG. 3 illustrates a difference in image sub-magnification with the sheet thicknesses t of 0.1 mm, 0.3 mm, and 0.4 mm when the radius R of the secondary transfer roller 36 is changed. Note that, the difference in image sub-magnification due to the difference in sheet thickness is defined as a sheet thickness error of image sub-magnification. For example, an allowable range of the sheet thickness error is indicated by double-headed arrow D in FIG. 3. The image sub-magnification falls within the range of 99.0% to 100.4%. That is, the allowable range is 1.4%, which is 5 mm when converted into the image length per A3 sheet. If the sheet thickness error exceeds the allowable range, a pitch error occurs in a raster image, which may result in an abnormal image.

In FIG. 3, the image sub-magnification is measured and plotted with the radius R of the secondary transfer roller 36 varied to 40 mm for each sheet thickness t. As illustrated in FIG. 3, as the radius R of the secondary transfer roller 36 increases, the image sub-magnifications (image length) of the sheets 46 having different thicknesses gradually approach the ideal value of 100%.

Figure 4:
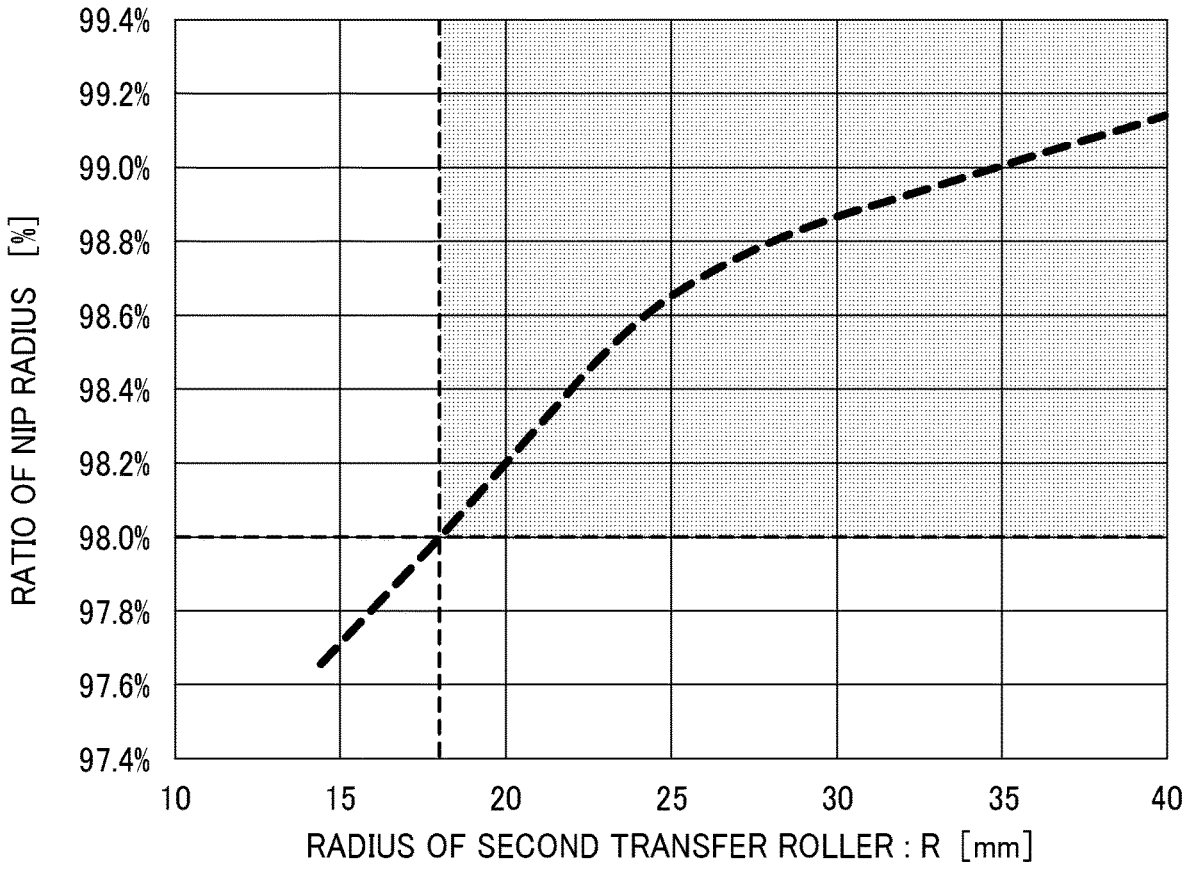
FIG. 4 is a graph illustrating an example of a relation between the radius R of the secondary transfer roller and a conditional expression.

FIG. 4 is a graph illustrating an example of a relation between the radius R of the secondary transfer roller 36 and a ratio of nip radius including the sheet thickness (i.e., the radius of curvature of the surface of the sheet 46 in the secondary transfer nip N2). In FIG. 4, the horizontal axis represents the radius R of the secondary transfer roller 36, and the vertical axis represents the ratio of the nip radius (radius of curvature) of the thin sheet with the thickness of t1 to the nip radius (radius of curvature) of the thick paper with the thickness of t2, that is, $(t1+R)/(t2+R)$.

Figure 5:
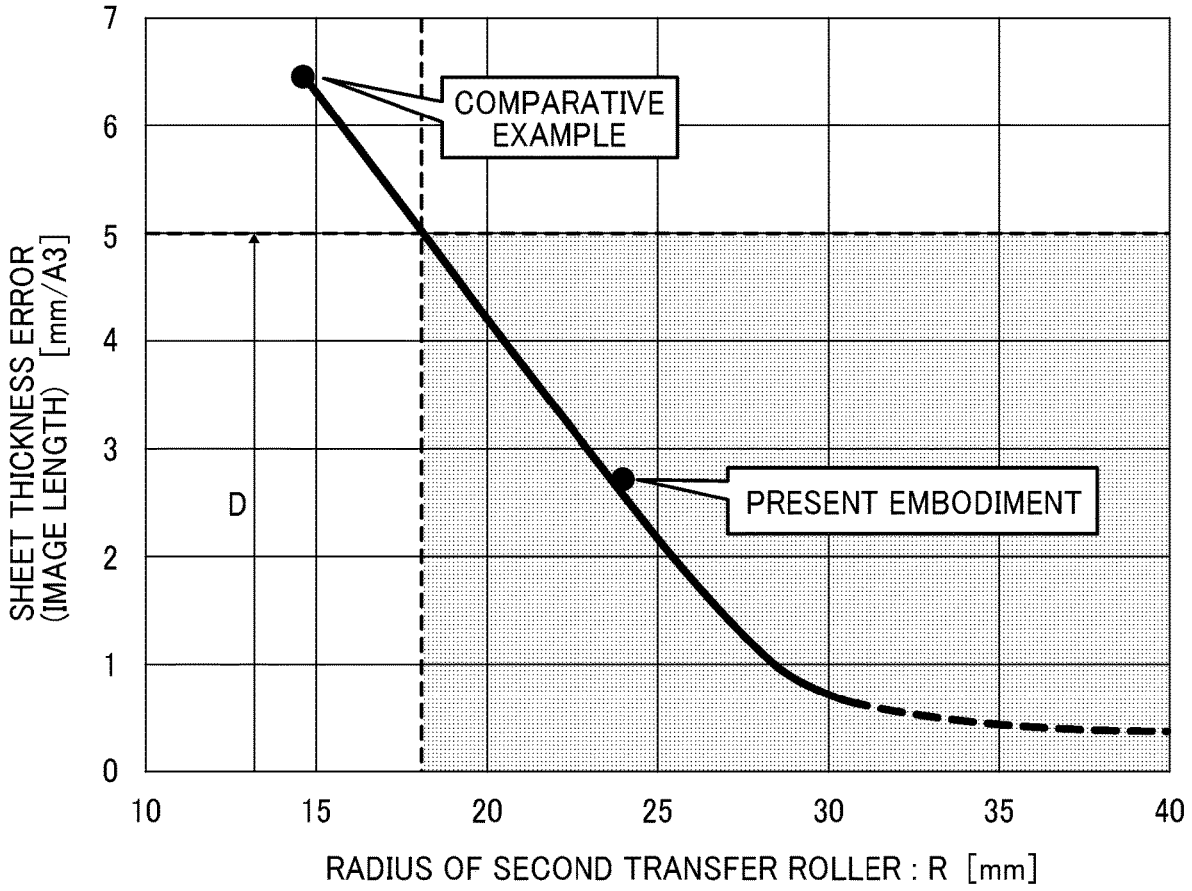
FIG. 5 is a graph illustrating the sheet thickness error of image sub-magnification in FIG. 3 as an image length.

FIG. 5 illustrates the sheet thickness error of image sub-magnification in FIG. 3 converted into a unit of length. In FIG. 5, it can be seen that the sheet thickness error approaches zero as the radius R of the secondary transfer roller 36 increases.

That is, in the present embodiment, the transfer device includes the rotatable intermediate transfer belt 31 configured to bear a toner image to be transferred to the sheet 46, the opposing roller 33, and the secondary transfer roller 36. The secondary transfer roller 36 is rotatable with the opposing roller 33 (and the intermediate transfer belt 31). The transfer device satisfies the conditional expression $(t1+R)/(t2+R)>0.98$, where t1 represents the thinnest thickness of the sheet 46, t2 represents the thickest thickness of the sheet 46, and R represents the radius of curvature of the secondary transfer nip N2, which corresponds to the radius of the secondary transfer roller 36. With this configuration, when the toner image is transferred from the intermediate transfer belt 31 to the sheet 46, the difference in linear velocity between the intermediate transfer belt 31 and the sheet 46 at the secondary transfer nip N2 is reduced even when the thickness t of the sheet 46 changes. Therefore, a toner coverage error (i.e., the difference in image sub-magnification due to the difference in the toner coverage) and the sheet thickness error of image sub-magnification can be reduced. As a result, the image sub-magnification can fall within, for example, the allowable range of sheet thickness error illustrated in FIG. 3.

The image sub-magnification, which corresponds to the length of the image on the sheet 46, is determined by the linear velocity of the sheet 46 when the toner image is transferred. In a comparative example, a linear velocity of an intermediate transfer belt and a linear velocity of a secondary transfer belt (or roller) are independent and have a difference therebetween. For this reason, the linear velocity of the sheet at the time of transfer depends on: the balance of frictional force and electrostatic attraction between the intermediate transfer belt and the sheet, and between the sheet and the secondary transfer belt (or roller); and the velocity difference between the intermediate transfer belt and the secondary transfer belt (or roller). In addition, the linear velocity of the sheet varies due to the thickness of the sheet and the amount of toner. When the linear velocity of the sheet changes, the image sub-magnification on the sheet also changes, which affects image quality (e.g., print position accuracy and front/back registration accuracy).

On the other hand, in the present embodiment, the secondary transfer roller 36 is rotatable with the intermediate transfer belt 31. For this reason, there is no difference in linear velocity between the intermediate transfer belt 31 and the secondary transfer roller 36, and the linear velocity of the sheet 46 also matches the linear velocity of the intermediate transfer belt 31 and the secondary transfer roller 36. Accordingly, the difference of the frictional force and electrostatic attraction due to the amount of toner does not affect the linear velocity of the sheet 46 and the image sub-magnification, thereby reducing the variation of the image sub-magnification. However, since the linear velocity of the sheet 46 changes with the thickness t of the sheet 46, the image sub-magnification also changes with the thickness t of the sheet 46 without considering the thickness t of the sheet 46. Therefore, even if the toner coverage error of image sub-magnification can be eliminated, it is difficult to reduce the variation of the image sub-magnification due to the sheet thickness error. This is because the thickness t of the sheet 46 causes a difference in the radius of curvature of the surface of the sheet 46 wound around the secondary transfer roller 36.

For this reason, in the present embodiment, the secondary transfer roller 36 rotates with the intermediate transfer belt 31. Further, the diameter (radius R) of the secondary transfer roller 36 is larger than at least that of the secondary transfer roller of the comparative example. Therefore, the difference in the radius of the surface of the sheet 46 due to the thickness t of the sheet 46 in the secondary transfer nip N2 becomes relatively small. As a result, the variation of the image sub-magnification due to the sheet thickness t can be reduced.

In the present embodiment, the secondary transfer roller 36 is harder than the opposing roller 33. For this reason, the shape of the secondary transfer nip N2 is a curved surface convex toward the opposing roller 33, so that the variation of the image sub-magnification due to the sheet thickness t can be further reduced.

In the present embodiment, since the intermediate transfer belt 31 serving as an image bearer is made of an elastic material, the toner coverage error and the sheet thickness error of image sub-magnification are likely to occur, although both can be minimized.

As described above, according to the present disclosure, a second rotator contacts an image bearer to form a transfer nip and rotates in accordance with the image bearer (and a first rotator). A toner image is transferred from the image bearer to a recording medium at the transfer nip. A thickness of the recording medium ranges from t1 to t2, and a radius of curvature of the second rotator is R. At that time, a transfer device satisfies a conditional expression $(t1+R)/(t2+R)>0.98$. As a result, a difference in linear velocity between the image bearer and the recording medium at the transfer nip is reduced even if the thickness of the recording medium changes, thereby reducing a toner coverage error and a sheet thickness error of image sub-magnification.

The effects obtained by the above-described embodiments are examples only, and are not limited thereto.

For example, both an opposing roller as a first rotator and a secondary transfer roller as a second rotator may be formed with a hardness satisfying $(t1+R)/(t2+R)>0.98$. For example, the secondary transfer roller may have a hardness identical to that of the opposing roller and deformable similar to the opposing roller. In this case, the opposing roller and the secondary transfer roller press against each other to form a secondary transfer nip and have substantially the same hardness, such that the radius of curvature of the transfer nip is sufficiently large to form the secondary transfer nip that is almost flat and thus the left side of the conditional expression $(t1+R)/(t2+R)>0.98$ approaches 1. As a result, the occurrence of the toner coverage error and the sheet thickness error of image sub-magnification can be further reduced.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A transfer device comprising:

a rotatable image bearer configured to bear a toner image to be transferred to a recording medium;

a first rotator; and a second rotator configured to contact the first rotator via the rotatable image bearer to form a transfer nip in which the recording medium is sandwiched, wherein the second rotator includes a radius that is sized based on a ratio of a thickness of a thinnest recording medium to pass through the transfer nip and a thickness of a thickest recording medium to pass through the transfer nip, and wherein the second rotator is sized to satisfy a conditional expression, $$(t1+R)/(t2+R)>0.98,$$

where t1 represents the thickness of the thinnest recording medium, t2 represents the thickness of the thickest recording medium, and R represents the radius of the second rotator.

2. The transfer device according to claim 1, wherein the second rotator is harder than the first rotator.

3. The transfer device according to claim 1, wherein the first rotator and the second rotator are configured to press against each other to form the transfer nip, and wherein the first rotator and the second rotator have an identical hardness.

4. The transfer device according to claim 1, wherein the rotatable image bearer is a belt made of an elastic material.

5. An image forming apparatus comprising the transfer device according to claim 1.

6. The transfer device according to claim 1, wherein the second rotator is configured to directly contact an outer surface of the rotatable image bearer.

* * * * *